United States Patent [19]

Von Hagen

[11] Patent Number: 4,498,406

[45] Date of Patent: Feb. 12, 1985

[54] SEWING MACHINE LUBRICATION SYSTEM

[75] Inventor: Wolf R. Von Hagen, Hemmingen, Fed. Rep. of Germany

[73] Assignee: Union Special G.m.b.H., Stuttgart, Fed. Rep. of Germany

[21] Appl. No.: 479,529

[22] Filed: Mar. 28, 1983

[30] Foreign Application Priority Data

Mar. 31, 1982 [DE] Fed. Rep. of Germany ..... 3211893

[51] Int. Cl.[3] ..... D05B 71/00

[52] U.S. Cl. ..... 112/256; 74/587; 384/380; 184/6.15

[58] Field of Search ..... 74/587, 605; 112/256; 285/94; 184/6.15; 384/288, 290, 291, 380, 375, 376, 389, 390

[56] References Cited

U.S. PATENT DOCUMENTS

| | | | |
|---|---|---|---|
| 569,045 | 10/1896 | Holt | 384/380 |
| 702,612 | 6/1902 | Atkin | 384/376 |
| 900,928 | 10/1908 | Hone | 384/375 |
| 1,289,903 | 12/1918 | Pogue | 112/256 X |
| 1,950,514 | 3/1934 | Plumley | 112/256 |
| 2,940,802 | 6/1960 | Love | 384/291 |
| 3,060,877 | 10/1962 | Ketterer | 184/6.15 X |
| 3,361,007 | 1/1968 | Belsanti et al. | 74/587 |
| 4,325,589 | 4/1982 | Hirt | 384/375 |

FOREIGN PATENT DOCUMENTS

| | | | |
|---|---|---|---|
| 229661 | 10/1925 | United Kingdom | 384/291 |

*Primary Examiner*—Werner H. Schroeder
*Assistant Examiner*—Andrew M. Falik
*Attorney, Agent, or Firm*—John W. Harbst; John A. Schaerli

[57] ABSTRACT

A lubrication system for eccentric drives in a sewing machine wherein lubricant is fed through a hollow drive shaft and communicative radial ports. At its outlet end, the radial port is in fluid communication with a lubricant reservoir arranged on the eccentric's periphery. The lubricant reservoir being disposed on that portion of the eccentric's periphery measuring the greatest distance from the eccentric's rotating center.

9 Claims, 3 Drawing Figures

SEWING MACHINE LUBRICATION SYSTEM

FIELD OF THE INVENTION

This invention relates to sewing machines and, more particularly, to lubrication systems for sewing machines.

BACKGROUND OF THE INVENTION

It has long been known that the basis of operation of various sewing machine mechanisms relies on the creation and sustenance of an adequate lubrication wedge between the rotating surfaces of the operating parts. Thus, a multitude of various lubrication systems have been devised to accomplish this end. The increased speed of today's machines, however, has led to problems relative to the lubrication and service life of various sewing machine components including eccentric bearings which are used to drive various gear trains.

The requirements for the lubrication of an eccentric bearing are severely exacting. Too little lubricant delivery at high speed operating conditions can cause the eccentric to over heat and seize. An excessive delivery of lubricant, on the other hand, may hinder its operation.

It is known in the art to direct lubricant through an axial bore in a drive shaft and through radial bores therefrom to the bearing surface. U.S. Pat. No. 3,418,955 granted Dec. 31, 1968 to J. G. Attwood, et al is one example of such means. This measure, however, has proven not sufficient by itself for reducing the increased friction in sliding or friction bearings wherein the machines are operated at higher speeds. As a result, many of the eccentric bearings in high speed sewing machines are today provided with roller or anti-friction bearings. The drawback with this solution is the undesirable noise which results.

BRIEF DESCRIPTION OF THE PRESENT INVENTION

Because of the above, and in accordance with the present invention, there is provided a lubrication system adapted to overcome the heretofore known problems.

The lubrication system of the present invention includes a drive shaft having a lubricant passageway extending therethrough and communicative radial ports for fluidically connecting the lubricant passageway and the bearing surface of the rotary actuating element. At its outlet end, the radial port is arranged in fluid communication with a lubricant reservoir means. The lubricant reservoir means extends over a segmented part of the eccentric's periphery. Preferably, the lubricant reservoir will be arranged or located on that portion or segment of the eccentric's periphery arranged the greatest distance from the rotating center of the eccentric. To enable use of the eccentric drive in either rotational direction, and equally for technological reasons, the lubricant reservoir may extend on either side of the radial port.

In line with the above, it is a primary object of this invention to provide a sewing machine lubrication system that is simple, economical, effective and dependable, and that will provide adequate lubrication at very high sewing speeds.

Another object of this invention is to provide a lubrication system which enables the use of eccentric drives and a quieter machine operation.

BRIEF DESCRIPTION OF THE DRAWINGS

Having in mind that additional objects and other attendent advantages may well become apparent from an understanding of this disclosure, the invention comprises the devices, combinations, and arrangement of parts as illustrated in the presently preferred form of the invention which is hereinafter set forth in detail to enable those skilled in the art to readily understand the function, operation, construction and advantages of same when read in conjuction with the accompanying drawings in which.

DETAILED DESCRIPTION OF THE PRESENT INVENTION

Figure 1:
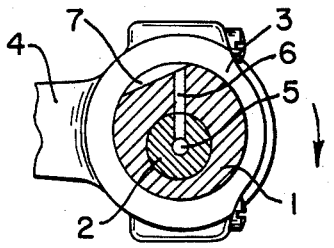
FIG. 1 illustrates an eccentric drive assembly wherein the draft shaft and eccentric are shown in section.

One advantage of the novel lubrication system according to this invention is that it provides an adequate supply of oil or lubricant to the operating parts of the sewing machine. For purposes of clarity, the illustrative details of a sewing machine have been omitted from the drawings and only that necessary for a complete understanding of the invention has been illustrated.

Turning now to the drawings, wherein like reference numerals indicate like parts throughout the several views, there is shown a rotary actuating mechanism including an eccentric driving assembly which is powered by the rotation of a shaft. The eccentric driving assembly may include an eccentric journal 1 adapted to rotate together with the drive shaft 2 in the direction of the arrow. Enveloping or surrounding the eccentric journal 1 is one end 3 of a pitman arm 4. The other end of pitman 4 may be adapted to drive a looper, feed dog, or other sewing machine instrumentality. Since the details of these later named mechanisms form no part of the present invention, it is believed unnecessary to describe them fully.

Figure 2:
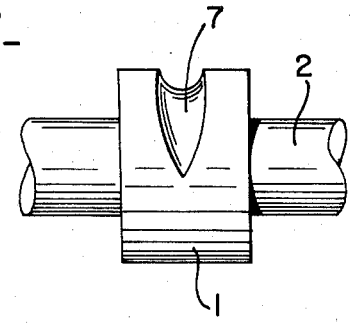
FIG. 2 is a side view of a drive shaft having a rotary actuator arranged thereon.

The lubrication system of the present invention includes a fluid inlet means for providing a supply of lubricant or fluid to the bearing surface formed between the periphery of the substantially smooth circular surface of the crank shaft or eccentric journal 1 and the substantially smooth circular internal surface of the pitman 3. Such fluid inlet means includes lubricant conducting passageway means 5 formed in the revoluble drive shaft 2. The lubricant conducting passageway may be arranged in communication with a lubricant pump (not shown) whereby lubricant under pressure may be introduced to the bearing surfaces. Preferably, the lubricant passageway 5 is coaxially arranged with respect to the shaft 2. A second lubricant conducting bore means 6 radially extends from the lubricant passageway to the bearing surface of the crank shaft journal 1. Preferably, the bore or port means 6 intersects the peripheral surface of the crank shaft journal 1 at a location disposed the greatest distance from the rotating center of the journal 1. At its outlet end, the radial port means 6 fluidically communicates and intersects with a lubricant reservoir means 7. As best seen in FIG. 2, the lubricant reservoir means includes a recess or pocket arranged on the peripheral surface of the crank shaft journal in which is disposed the supply of lubricant received from the lubricant passageway 5 via the port means 6.

Figure 3:
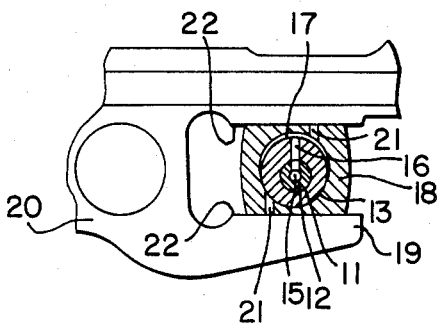
FIG. 3 illustrates, partially in cross section, another embodiment of the present invention.

In the embodiment shown in FIG. 3, an eccentric 11 is arranged on a revoluble drive shaft 12. The eccentric 11 is embraced or enveloped by a block 18 slidably mounted between the fork portion 19 having two spaced tines defining a slideway formed at the distal or forward end of a feed bar carrier means 20. Such construction enables vertical feed lift motions to be imparted to the feed bar. Like shaft 2, the shaft 12 also features a lubricant conducting passageway 15. Radially extending from the passageway 15 to the bearing surface created between the eccentric's periphery and the enveloping slide block is a lubricant conduit 16. The radial conduit 16 is arranged in fluid communication with a lubricant reservoir means 17. The reservoir means 17 is arranged on a segmented peripheral portion of the eccentric's periphery. Here again, the groove or recess defining the lubricant reservoir is preferably arranged on that portion of the eccentric's periphery diposed the greatest distance from the journal's rotating center.

As does shaft 2 and eccentric 1, the eccentric 11 and shaft 12 rotate together. Leading from the bearing surface 13 formed between the sliding block 18 and the eccentric 11 are one or more channel means 21. The channel means extend to and emerge at a point generally intermediate the ends of the sliding surfaces 22. Preferably, the channels 21 extend generally perpendicular to the sliding surfaces 22 and are generally tangent to the bearing surface 13. By this construction, lubricant is removed from the bearing surface 13 in an area of secondary lubricating significance relative to the pressure build up in this particular bearing.

Thus there has been provided a Sewing Machine Lubrication System which fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

Thus, adequately described the invention, what I claim is:

1. A sewing machine lubrication system comprising:

a revoluble crankshaft provided with lubricant conducting means, said crankshaft includes at least one eccentric rotary actuating element having a peripheral bearing surface and an axis about which the eccentric element rotates;

lubricant conducting bore means radially extending from the lubricant conducting means of said crankshaft and reaching to a location on the bearing surface of said eccentric rotary actuating element spaced substantially the farthest distance from the axis of rotation of said eccentric actuating element; and lubricant reservoir means provided on the bearing surface of said eccentric rotary actuating element over an area intersected by said radial lubricant conducting bore means.

2. In a machine having operating parts to be lubricated, a lubrication system comprising:

a rotary crank shaft including at least one eccentric journal having an axis about which the journal rotates, with said journal being provided with a lubricant passageway extending therethrough;

at least one of said operating parts needing lubrication surrounding said eccentric journal;

a radial port means in said eccentric journal extending from and angularly to said lubricant passageway for fluidically connecting said part with said lubricant passageway; and lubricant reservoir means extending over an area of the eccentric journal's periphery spaced substantially the farthest distance from the rotational axis of said eccentric and intersecting said radial port means.

3. A lubrication system for a sewing machine having a revoluble drive shaft, an eccentric arranged for rotation with said shaft, a sliding block enveloping said eccentric whereby creating a bearing surface therebetween, said sliding block being slidingly disposed between spaced tines of a feed carrier means, said lubrication system comprising:

lubricant reservoir means arranged on a segmented peripheral portion of said eccentric;

means for providing lubricant to said bearing surface and to said lubricant reservoir means; and lubricant conduit means formed in said sliding block for delivering lubricant from said bearing surface to the spaced tines of the feed carrier means.

4. A lubrication system according to claim 3 wherein said lubricant conduit means are arranged generally tangential to the bearing surface.

5. A lubrication system according to claim 4 wherein said lubricant conduit means extend generally perpendicular to the lubricated spaced tine surfaces.

6. A lubrication system for a sewing machine having a rotary shaft having a central axis, an eccentric journal arranged for rotation with said shaft and having a center about which the journal rotates, a connecting rod connected to said eccentric journal whereby creating a bearing surface therebetween, said lubrication system comprising:

a first lubricant passageway in the rotary shaft arranged generally coaxial with the central axis thereof;

a second lubricant passageway arranged in fluid communication with said first lubricant passageway and extending radially outward therefrom to a peripheral location on the eccentric journal located the greatest distance from the eccentric journal's center; and lubricant storage means provided on the periphery of said journal over a segmented area intersected by said second lubricant passageway.

7. In a sewing machine having an eccentric provided with an axis about which the eccentric rotates and a substantially smooth circular outer surface, means having a substantially smooth circular inner surface arranged about said eccentric, means to cause relative motion between said surfaces, and a lubrication system comprising:

a fluid inlet means providing a supply of fluid between said surfaces; and lubricant reservoir means segmentally arranged on the smooth circular outer surface of said eccentric over an area disposed substantially the farthest distance from the eccentric's axis of rotation and which is intersected by said fluid inlet means.

8. The lubrication system of claim 7 wherein said lubricant reservoir means is a recess formed on said eccentric's smooth circular surface.

9. The lubrication system of claim 8 wherein said reservoir means extends to both sides of said fluid inlet means.

* * * * *